US005327400A

United States Patent [19]

Dubois

[11] Patent Number: 5,327,400

[45] Date of Patent: Jul. 5, 1994

[54] TIME PIECE WITH LUNAR PHASE AND TIDES DISPLAY

[75] Inventor: Jean-Daniel Dubois, Le Sentier, Switzerland

[73] Assignees: Nouvelle Lemania SA, L'Orient; Eberhard & Cie SA, Bienne, both of Switzerland

[21] Appl. No.: 868,501

[22] Filed: Apr. 15, 1992

[30] Foreign Application Priority Data

Apr. 15, 1991 [CH] Switzerland ..... 1112/91

[51] Int. Cl.[5] ..... G04B 19/26

[52] U.S. Cl. ..... 368/19

[58] Field of Search ..... 368/16, 18, 19

[56] References Cited

U.S. PATENT DOCUMENTS

| | | | |
|---|---|---|---|
| 246,061 | 8/1881 | Blair | 368/19 |
| 2,677,928 | 5/1954 | Haynes | 368/19 |
| 5,086,416 | 2/1992 | Dubois et al. | 368/19 |
| 5,086,417 | 2/1992 | Kerr | 368/19 |

FOREIGN PATENT DOCUMENTS

| | | |
|---|---|---|
| 0396473 | 11/1990 | European Pat. Off. . |
| 2454761 | 5/1976 | Fed. Rep. of Germany . |
| 86107984 | 7/1986 | Fed. Rep. of Germany . |
| 2500181 | 8/1982 | France . |
| 2645977 | 10/1990 | France . |
| 62-263490 | 11/1987 | Japan . |
| 672223 | 5/1990 | Switzerland . |

*Primary Examiner*—Bernard Roskoski
*Attorney, Agent, or Firm*—Young & Thompson

[57] ABSTRACT

The present invention has for its object a watch movement more particularly a wrist watch, a chronograph watch or a pocket watch which comprises a time display formed by a dial and hands and which comprises a tide indicator constituted by a tides disk 16 which is to be seen through a window of the dial 5 and which makes one turn in twenty-four hours. This disk is driven in rotation through the hand display. A moon phases hand 15 is also driven by the hand display, at the speed of one turn in 29.5 days and cooperates simultaneously with the tides disk 16 and with the signs 20 to 23 representing the phases of the moon disposed on the dial 5 around the tides disk 16.

7 Claims, 6 Drawing Sheets

TIME PIECE WITH LUNAR PHASE AND TIDES DISPLAY

The present invention has for its object a time piece, more particularly for a wrist watch, a chronograph or a pocket watch, which comprises a time display constituted by a dial as well as hands and possibly a chronograph display, as well as the conventional mechanisms associated to these displays. This time piece comprises further a tide indicator that means a display indicating at the same time the movement of the tides and the moon phases.

One knows from patent DE-A-24 54 761 a time piece which comprises a display of the movement of the tides constituted by a central hand, independent from the hands of the time display, cooperating with indexes carried by the dial, indicating the high and low tides. Such a movement does not enable to indicate simultaneously the moon phases.

One knows further from document FR-A-b 2 500 181 a time measuring apparatus which comprises on top of a time display, a plurality of distinct displays such as a tide clock, a moon clock, and astronomical clock having a moon dial and possibly a second time display. All these displays are distinct and cannot be combined, which does not enable the use of such a time measuring apparatus for a portable watch. Furthermore, for the user, particularly the sailor or the yacht man, it is absolutely necessary to be able to know at one glance the indication of the tide movement as well as the indication of the moon phases, which cannot be realized with the apparatus described in this document.

One knows finally from the document CH 672 223 a time measuring apparatus having a tide indicator which comprises on top of the time display, a window in the dial the periphery of which has indexes cooperating with signs, which are carried by a rotative disk under the dial, the position with respect to the indexes indicates the state of the tide. Here also it is only a tide display, this apparatus do not comprise any indication relative to the moon phases.

The aim of the present invention is to remedy to the drawbacks of the time pieces existing and which permits particularly for yachtmen and sailors to integrate in a wrist watch or in a pocket watch an indicator showing simultaneously the movement of the tides and the moon phases.

The present invention has for its object a time piece comprising a time display, a motor gearing, a regulating gearing and a winding up mechanism comprising a winding up stem enabling to wind the motor in a first position and enabling the setting to time of the time display in a second position, characterized by the fact that it comprises further a tide indicator, indicator which combines the moon phases and the movements of the tides, comprising a tide disk which is to be seen through a window of the dial and which makes one turn in twenty-four hours driven in rotation by the time display; a moon hand driven also by the hand display at a speed of one turn in 29.5 days cooperating simultaneously with the tide disk and with signs representing the phases of the moon which are located on the dial around the tide disk.

The attached drawing shows schematically and by way of example one chronograph watch according to the invention.

Figure 4:
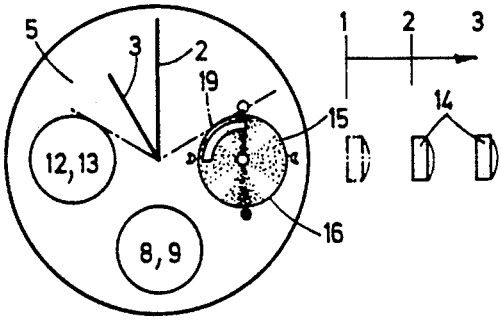

FIG. *6a*, *6b* are a cross-section along line V—V of FIG. 4.

FIG. *7a*, *7b* are a cross-section along line VI—VI of FIG. 4.

Figure 8:
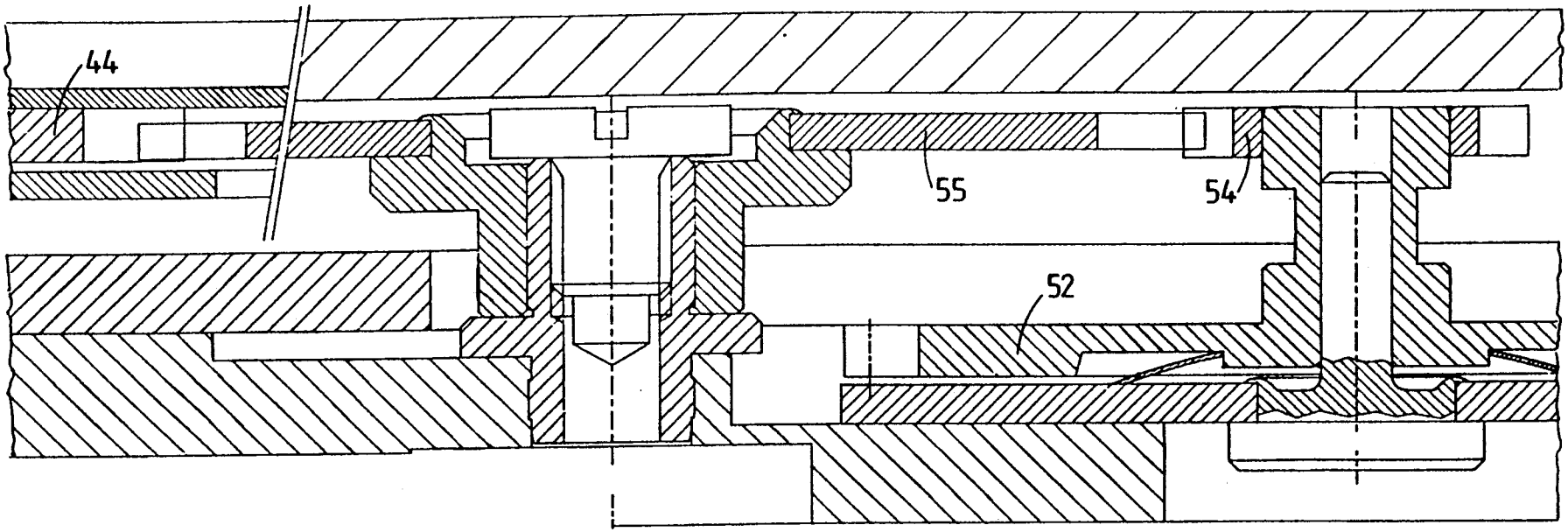

FIG. 8 is a cross-section along line VII—VII of FIG. 4.

Figure 9:
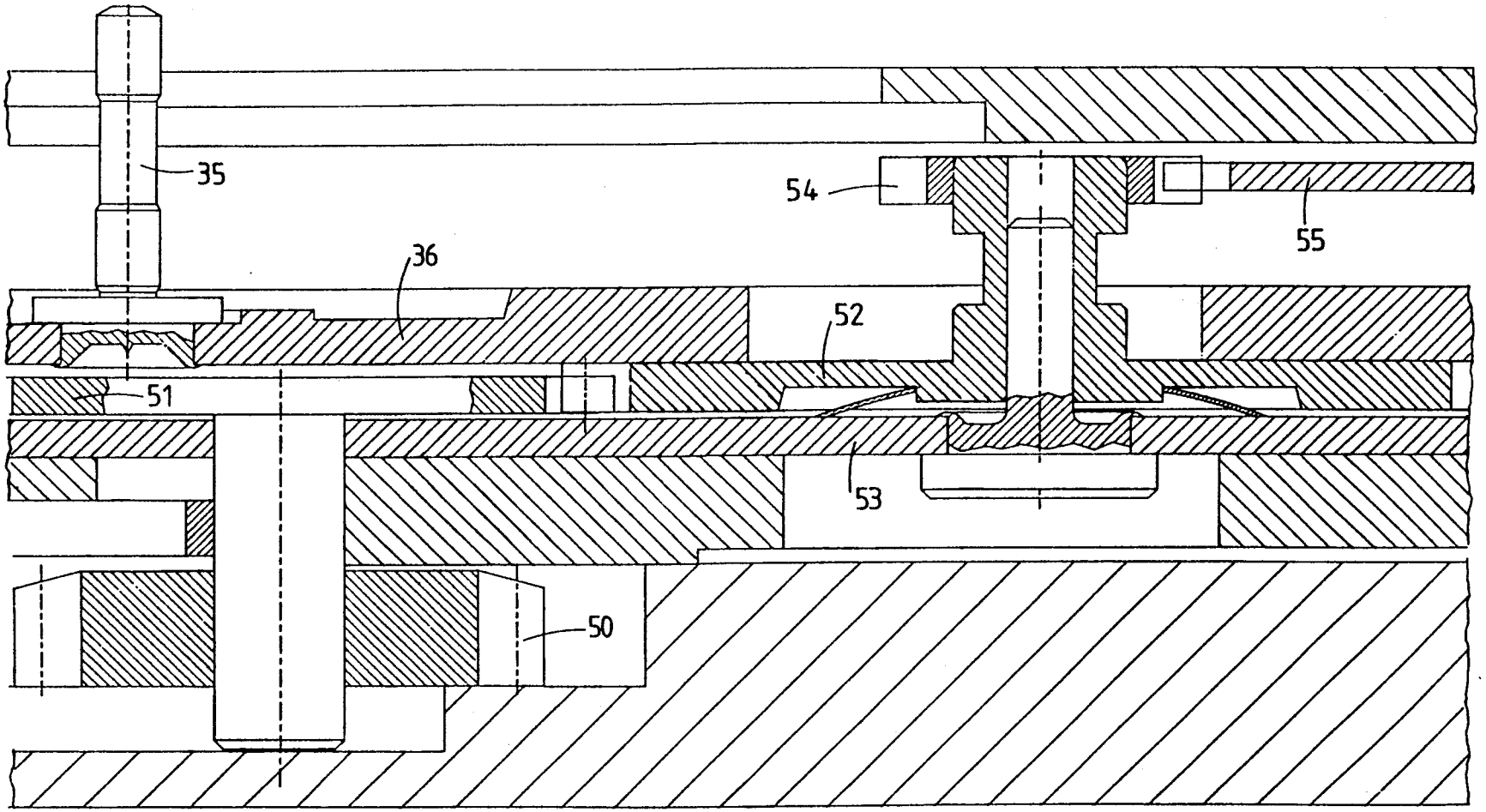

FIG. 9 is a cross-section along line VIII—VIII of FIG. 4.

Figure 1:
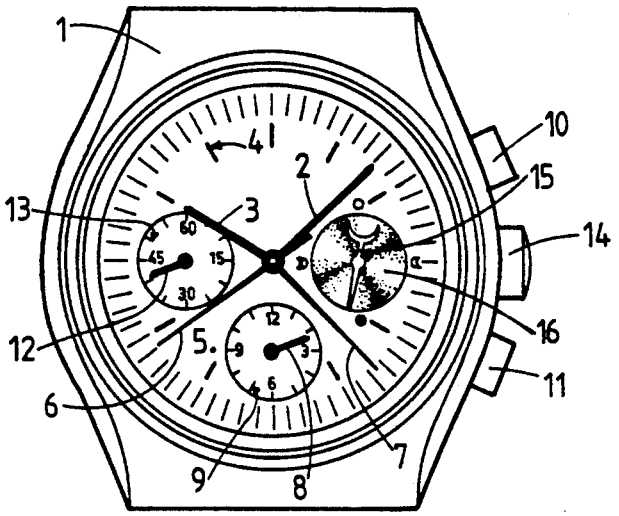
FIG. 1 is a plan view of the chronograph watch comprising a time display, chronograph displays as well as a combined display of the tide movements and of the moon phases.

The chronograph watch shown at FIG. 1 comprises a casing 1 in which the watch movement is located. This watch comprises a time display comprising minutes 2 and hours 3 hands at the center, cooperating with a peripheric graduation 4 of a dial 5. The hands 2 and 3 are driven by a conventional gearing activated by a spring motor and a motor gearing and regulated by a regulator gearing which is conventional and not shown.

This chronograph watch comprises further a chronograph seconds hand at the center 6 and a co-axial minutes chronograph hand 7 both cooperating with the peripheral graduation 4 of the dial 5. This chronograph watch comprises further an hours counter for the chronograph presenting a hand 8 cooperating with a graduation 9 located at six o'clock of the dial 5. The chronograph hands 6,7 and 8 are driven by a chronograph mechanism, actuated by push members 10 and 11, of conventional type.

The watch shown comprises further a little seconds hand 12 cooperating with a graduation 13 located at nine o'clock of the dial 5.

The movement comprises further a winding stem 14 having three axial positions.

The chronograph watch shown comprises further a time display or indicator combined with moon phases and tide movements, the display of which, located at three o'clock on the dial 5, comprises a hand for the moon phases 15 pivoted concentrically to a rotative tide disk 16. This moon phases hand makes one complete revolution for each moon cycle and cooperates simultaneously with the tide disk, which makes one revolution in twenty-four hours, as well as with representation of the state of the moon, full, new moon, increasing or decreasing moon, located on the dial 5 around the tide disk 16.

Figure 2:
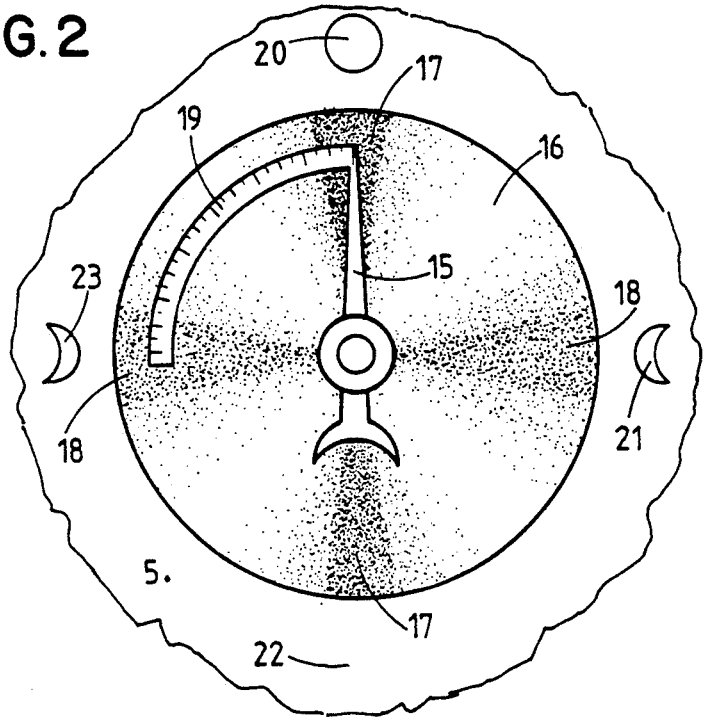
FIG. 2 is a plan view at greater scale and which is schematic of the display of the tides movements and of the moon phases shown at FIG. 1.

The display of the tide indicator is shown in detail at FIG. 2, it comprises a tide disk 16 which can be seen through a circular window provided in the dial 5. This tide disk 16 comprises different colored zones 17,18 indicating respectively the high and low tides. The portions of this disk 16 located between the zones 17,18 can have shades of colours. This display comprises further the moon phases hand 15 pivoted concentrically to the tide disk 16. This moon phases hand 15 comprises at its end a graduated sector 19, extending on about a quarter of a circle. This sector extends thus over an angular distance or arc of circle corresponding to a fourth of the tide disk 16, that is to say over a distance corresponding to six hours that is the time interval separating a low tide from a high tide. As said before, the tide disk 16 makes one revolution in twenty-four hours and turns in the direction of the watch hands whereas the moon phases hand 15 and its sector 19 representing half a tide cycle (6 h 12 min) will make in the same direction one revolution during a moon cycle, i.e. within 29.5 days. This moon cycle hand indicates the phase of the moon by cooperating with the signs 20,21,22,23 representing the moon phases which are applied to the dial 5 around the disk 15. Simultaneously, this hand 15 indicates the position of the tide in differential values of the position of the zones 17,18 of the tide disk 16 with respect to the arrow of the hand 15.

When the hand 15 is located at the center of the zone 17, the high tide is at its culminent point and it will enter in its decreasing phase. It expresses itself by two tides or periods within twenty-four hours and forty eight minutes and forty-eight seconds.

The sector 19 enables to represent graphically the approximate time of half a tides cycle or period. In using this sector, we can note that:

- in three hours six minutes one will be in a neutral zone.
- in six hours twelve minutes one will be at the culminent point of the low tide.

In looking at FIG. 2, we can see that:

- the arrow of the hand 15 of the moon phases indicates that one is in a period of full moon since it is in front of the sign 20.
- the arrow of the hand 15 of the moon phases which is superimposed to the center of the zone 17 indicates that one is at the culminent point of a high tide.
- the sector 19, which is fast with the arrow of the hand of the moon phases 15, superimposed with the tide disk 16 enables to read approximately the time resting until the next low tide.

Figure 5:
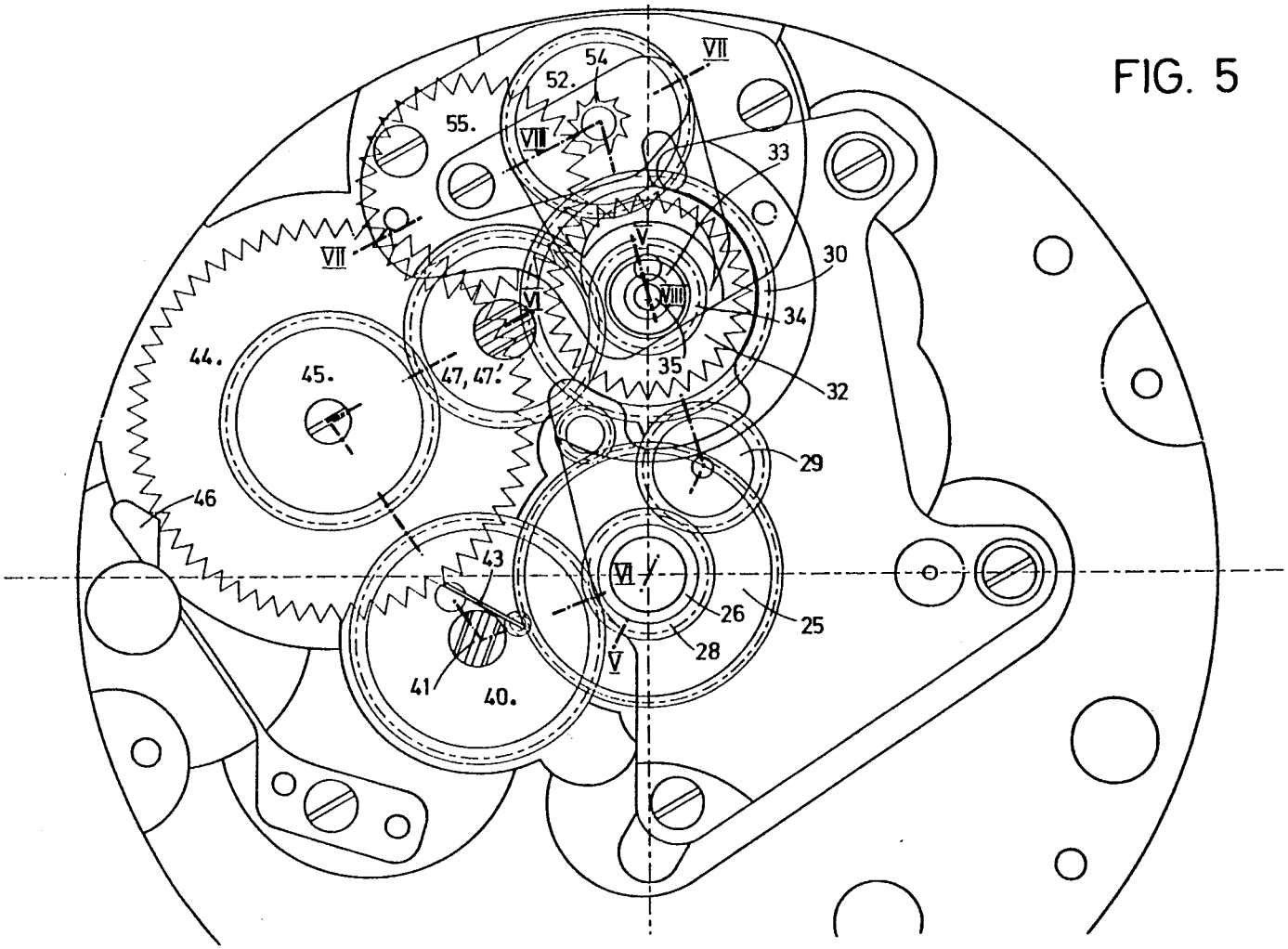
FIG. 5 is a top view of the movement on the dial side, of the watch shown at FIG. 1.
Figure 6A:
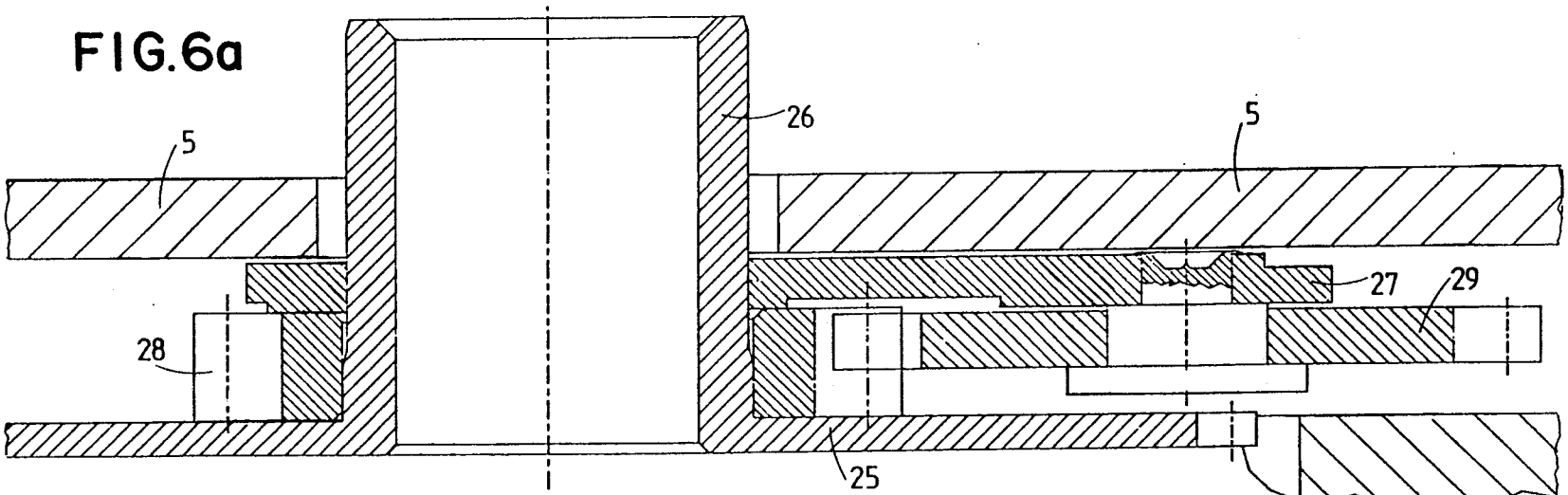
Figure 6B:
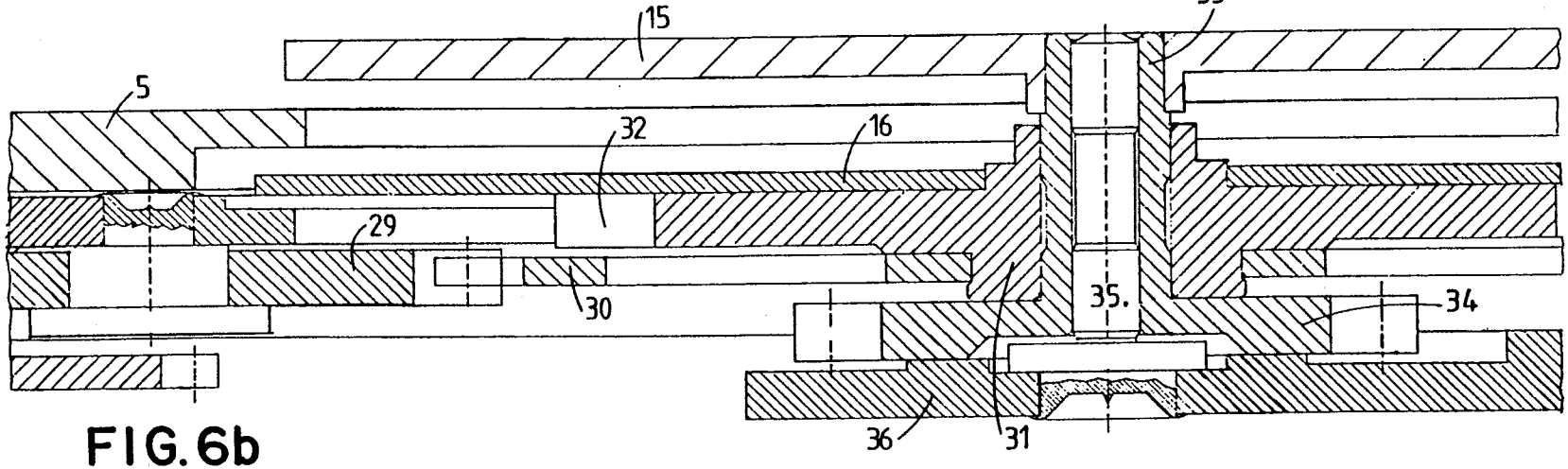
Figure 7A:
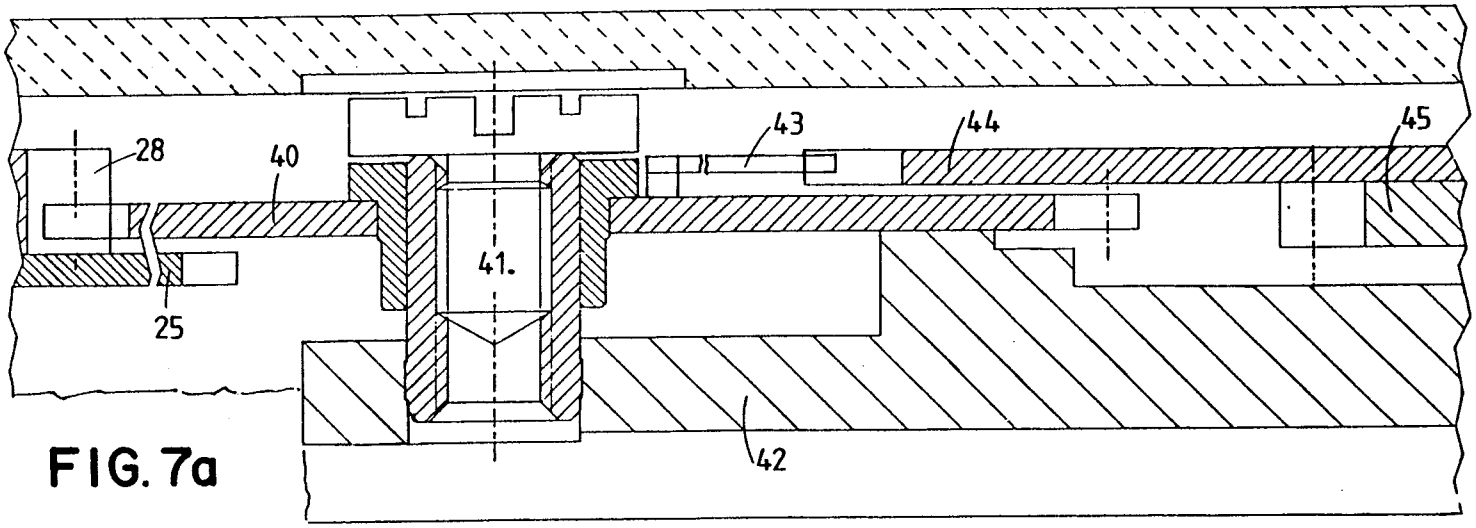
Figure 7B:
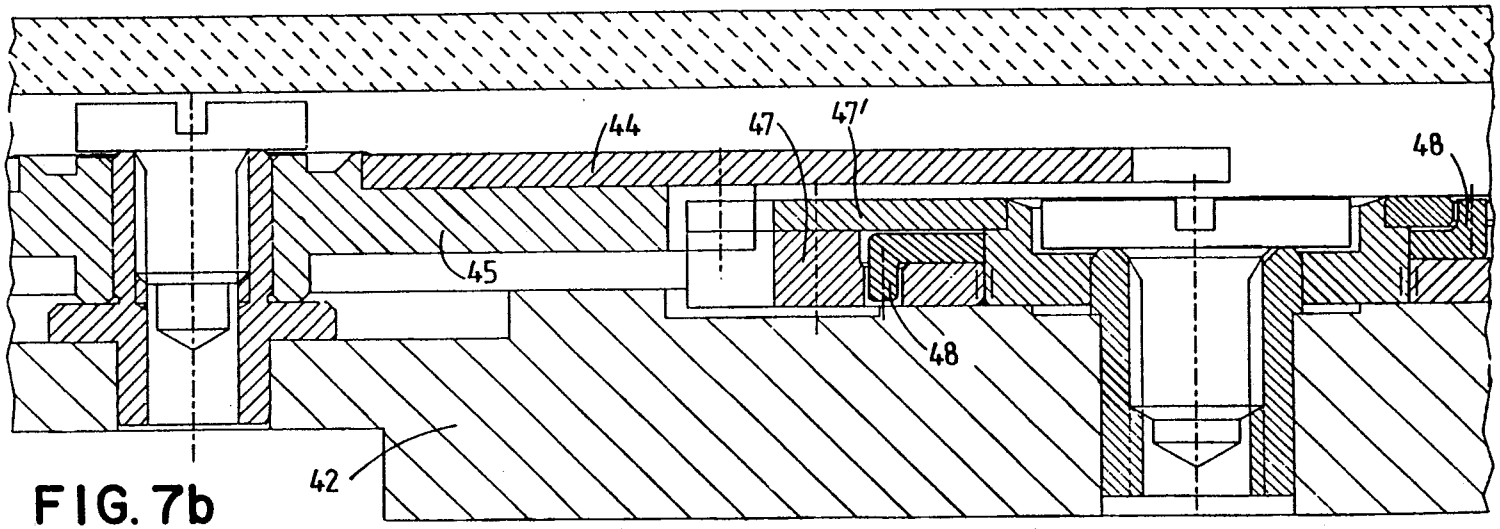

FIGS. 5 and 9 show the mechanism of the movement of the chronograph watch which relates to the tide indicator, for its working and for its setting. The movement comprises a hour wheel 25, the sleeve 26 of which is pivoted in a bridge 27 located just under the dial 5. A pinion 28 is carried by the sleeve 26 and meshes with an intermediate tide gearing 29 pivoted in the bridge 27 and itself meshing with a tide wheel 30 mounted with friction onto the hub 31 of the regulating star 32 of the tides disk 16. This star 32 carries the tide disk 16 and it is pivoted on the sleeve 33 carrying the moon phases hand 15. The sleeve 33 is fast with a wheel 34 and is pivoted on a shaft 35 mounted in a stud 36. In working, the tides disk 16 is driven at a rate of one turn in twenty-four hours by the hours wheel 25 by means of the gear 29 and of the wheel 30.

The driving of the moon phases hand 15 is also made from the hours wheel 26 by means of a gearing effectuating the necessary demultiplication so that this moon phases hand 15 revolves in 29.5 days. This gearing comprises a driving wheel 40 meshing with a pinion 28 fast with the hour wheel 25, the driving wheel 40 pivoted on an axis 41 fixed onto the support 42. This driving wheel 40 carries at its upper face a blade spring 43 which cooperates with a toothed disk 44 having 59 teeths fast with a wheel 45 also pivoted on the support 42. This toothed disk 44 is maintained in its successive angular positions by means of a spring member 46 and is driven stepwise by the blade spring 43 at each revolution of the driving wheel 40. The wheel 45 meshes with a driving intermediate gearing 47,47' pivoted on the support 42 and comprising two wheels 47,47' having identical toothing tending to displace angularly under the effect of a spring 48 so that the teething of the wheel 47,47' compresses the teeths of the wheel 45 and suppresses any play. This driving intermediate wheel 47,47' meshes with the wheel 34 which is fast with the sleeve 33 carrying the moon phases hand 16. In this mechanism, the moon phases hand 16 is always driven through the hours wheel. The tides disk 16 is normally driven, as described hereabove also through the hours wheel 25, but can be set manually by means of the winding stem when it is located in its second position, that means in its intermediate axial position.

In fact in this second or intermediate position of the winding stem 14, the pinion which it drives meshes with a correcting gearing 50 of a movable member the wheel 51 of which meshes with the wheel 52 of its second movable member, both being pivoted on the same tilting lever 53, the pinion 54 of which meshes with an intermediate correcting wheel 55, itself meshing with the star 32 for the setting of the tides disk 16.

Thanks to this mechanism, one can wind the movement in a conventional manner, by means of the winding stem 14 when it is in its first position; make a rapid correction of the tides disk 16, without modifying the time display, when the winding stem 14 is in its intermediate position; and cause the time setting, causing simultaneously the driving of the tide indicator, that is of the disk 16 and of the hand 15, when the winding stem is in a third axial position. The working of the winding stem in its first position and in its third position is conventional and will not be described here for more clarity.

Before setting the tide display, it is necessary to initialize the moon phase. This setting can be done on the base of a calendar. Referring to FIG. 2, this initialization is made in the following way:

The moon phases hand 15 indicates the full moon 20. According to the calendar consulted, the moon is for example at its decreasing fourth. It is thus necessary to displace forward the hand 15 up to the sign 21. As the hand 15 springs at midnight, it is necessary in order to put this hand forward to:

- set the stem of the watch in the third position (corresponding to the time and moon phase correction);
- drive forward the hours and minutes hands 2 and 3 until midnight;
- the moon phases hand 15 steps forward of one phase or one moon day;
- to come back with the hours and minutes hands 3,2 backward up to twenty-two hours, then come again to midnight. The moon phases hand 15 is again put forward of a value corresponding to one moon day. One proceeds thus that way until the angular position of the moon phases hand 16 is the desired position corresponding to the calendar, in this example in front of the sign 21;
- this being done, the watch is set to time by means of the winding stem being in its third position, driving thus simultaneously the moon phase hand 15;
- finally, one replaces the winding stem 14 in its first winding up position.

Figure 3:
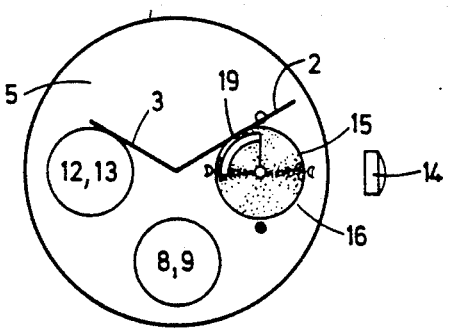
FIGS. 3 and 4 show schematically the setting of the tide display.

Once this setting of the position of the moon phases hand 15 is done, one can set the time display in function of the place, thus of the tides, where one stands. This is made for example in the manner described hereunder with reference to FIG. 3 and 4.

Arriving at the harbour at ten o'clock and ten minutes (FIG. 3) the official indicator of the place where one stands indicates that the low tide will be at eleven o'clock. One proceeds thus in the following manner:

pull the winding up stem 14 in third position (time correction) and set the watch at 11 o'clock (FIG. 4).

set the winding stem in intermediate position or second position (rapid correction of the tides disk 16) and juxtapose the zone 18 (low tide) of the disk 16 onto the arrow of the moon phases hand 15;

replace the winding up stem 14 in third position and reset the watch at the real time, here ten minutes past ten o'clock, increased from the time which elapsed during the manipulation;

reset the winding up stem 24 in its winding up position, the indication of the tides being now synchronized.

Thus, with this very simple operation, the tide indicator can be set for a given harbor and a given time. Once it has been set, this tide indicator gives at one glance the indication of the moon phase, the actual state of the tide and the possibility to estimate by means of the sector 19 the time which will elapse until the following low or high tide state.

I claim:

1. In a time piece comprising a dial, a time display, a motor that drives gearing, a winding mechanism comprising a winding stem enabling the winding of the motor in a first position and the time setting of the time display in a second position; the improvement wherein the time piece comprises further a time indicator, displaying simultaneously the moon phases and the tides, comprising a tides disk which can be seen through a window of the dial and which is driven by the gearing to make one turn in twenty-four hours, and a moon phase hand driven also by the gearing but at a speed of one turn in 29.5 days and which overlies the tides disk and points successively to signs representing the phases of the moon which are located on the dial around the tides disk, and wherein the end of the moon phase hand carries a graduated sector, extending over about one fourth of a circle, and which is concentric to the tides disk.

2. Time piece according to claim 1, wherein the moon phase hand is concentric to the tides disk and wherein this hand as well as the tides disk are driven, through different gearings, by an hours wheel of a hand display of the time piece.

3. Time piece according to claim 1, wherein the tides disk comprises indicia indicating the high and low tides and dividing the tides disk into four quarters.

4. Time piece according to claim 1, which comprises further a rapid setting mechanism of the tides disk permitting this disk to revolve independently from a hands display of the time piece and from the moon phase hand, this rapid setting mechanism being drive by the winding stem when the winding stem is in a third axial position.

5. Time piece according to claim 1, wherein the tides disk is eccentric of the time piece.

6. Time piece according to claim 1, which further comprises an eccentric small seconds display.

7. Time piece according to claim 1, which further comprises a chronograph mechanism comprising chronograph hands for the minutes and for the seconds which are centered on the time piece, cooperating with a peripheral graduation of time display on the dial as well as an eccentric hours counter.

* * * * *